US005213700A

United States Patent [19]

Smith

[11] Patent Number: 5,213,700

[45] Date of Patent: May 25, 1993

[54] METHOD OF LUBRICATING A TEXTILE MACHINE

[75] Inventor: Michael P. Smith, Port Arthur, Tex.

[73] Assignee: Texaco Inc., White Plains, N.Y.

[21] Appl. No.: 839,155

[22] Filed: Feb. 21, 1992

Related U.S. Application Data

[63] Continuation-in-part of Ser. No. 702,542, May 20, 1991, abandoned.

[51] Int. Cl.[5] ..... C10M 129/16

[52] U.S. Cl. ..... 252/52 A

[58] Field of Search ..... 252/52 A

[56] References Cited

U.S. PATENT DOCUMENTS 1,970,578 8/1934 Schoeller ..... 252/52 A 1,984,421 12/1934 Muench ..... 252/52 A 3,816,346 6/1974 Coppock ..... 252/32.5

*Primary Examiner*—Jacqueline V. Howard

*Attorney, Agent, or Firm*—James L. Bailey; Jack H. Park; Richard A. Morgan

[57] ABSTRACT

A textile machine is lubricated with oil characterized as non-staining to nylon textile. The lubricating oil comprises a paraffinic base lubricating oil and 1 to 3 wt % of a surfactant of the formula:

$$R—O(CH_2CH_2O)_xH$$

wherein: R is a normal paraffin radical of 11 to 15 carbon atoms and x ranges from 3 to 5.

11 Claims, No Drawings

METHOD OF LUBRICATING A TEXTILE MACHINE

CROSS REFERENCE TO RELATED APPLICATION

This is a continuation-in-part of Serial No. 07/702,542 filed May 20, 1991 for Textile Machine Lubricating Oil to Michael P. Smith, now abandoned.

1. Field of the Invention

This invention relates to lubricating a textile machine with a lubricating oil composition comprising a mineral oil and a selected surfactant.

2. Description of Other Related Methods in the Field

A textile machine lubricant must perform satisfactorily in textile mill service where adequate lubricating properties and compatibility with the textile being woven are equally important. Particularly where machine instrumentalities are lubricated with fine airborne mists, oil mist fogs in the atmosphere come in contact with the textile being woven and can cause stains which are not removed by washing. A lubricant which is not removed from textile by simple washing is unsatisfactory for textile machine use.

Textile fabrication requires a number of different manufacturing steps. Each manufacturing step requires machinery specific to that step and appropriate treating solutions.

U.S. Pat. No. 3,634,236 to J. R. Buster et al. teaches a lubricating finish for spandex fibers. The finish comprises a solution of liquid siloxane and a surfactant in mineral oil. One surfactant is an ethoxylated aliphatic alcohol of the formula $RO(CH_2CH_2O)_nH$. In this formula, R is an alkyl radical of from 8 to 20 carbon atoms and n has an average value of from 3 to 8.

U.S. Pat. No. 4,343,616 to Q. W. Decker et al. teaches lubricant compositions for finishing synthetic fibers. The composition comprises 50 to 90 wt% of a thermally stable lubricant and 10 to 50 wt% of a surfactant of the formula R—O—(AB)—H. R is an alkyl of 6 to 14 carbon atoms, A is an oxypropylene group and B is an oxyethylene group.

Great Britain 1,495,146 to R. E. Atkinson teaches a controlled sudsing detergent composition. Included in the detergents is a polyethoxy nonionic surfactant of the formula $RO(CH_2CH_2O)_mH$ wherein the hydrocarbyl group R and m are chosen to give advantageous cleaning characteristics.

SUMMARY OF THE INVENTION

The invention is a method of lubricating textile machine. A lubricating oil composition is applied to bearing and other lubricated surfaces. The composition comprises a mineral base lubricating oil and 1 to 5 wt% of an oil soluble surfactant of the formula:

$$R—O(CH_2CH_2O)_xH$$

wherein: R is a normal paraffin radical of 11 to 15 carbon atoms and x ranges from 3 to 5. The lubricating composition is particularly characterized as non-staining to nylon textile.

DESCRIPTION OF THE PREFERRED EMBODIMENTS

Most textile machine lubricating oils are highly refined, hydrotreated naphthenic oils which have been acid treated and clay treated to improve color and color stability. Environmental concerns associated with acid and acidic clay disposal have caused lubricating oil manufacturers to search for oils made by alternate processing such as by hydrogenation.

In the manufacture of lubricating base oils from petroleum feedstocks, crude oil fractions boiling in the desired lubricating base oil range are solvent extracted to remove aromatic compounds. Suitable extraction solvents include furfural, N-methyl-2-pyrrolidone, phenol and sulfur dioxide. In a lubricating oil extraction with N-methyl-2-pyrrolidone, the solvent extraction is carried out to recover about 30 to 90 vol% of the lubricating oil charge as a raffinate and to reject 10 to 70 vol% of the charge as an aromatic extract. The lubricating oil stock is contacted with the solvent at a temperature of at least 10° C., preferably at least 50° C., below the temperature of complete miscibility of the lubricating oil stock in the solvent.

Operating conditions for the extraction are selected to produce a primary raffinate having a dewaxed viscosity index of about 75 to 100. Solvent extraction temperatures are generally within the range of 43° C. to 100° C. (110° F. to 212° F.) and solvent dosage within the range of 50% to 500%. A solvent extraction process is more fully described in U.S. Pat. No. 4,328,092 to A. Sequeira, Jr. incorporated herein by reference.

Lubricating oil fractions from paraffinic crudes are dewaxed after solvent extraction to reduce the pour point of the resulting lubricating base oil. Both solvent dewaxing and catalytic dewaxing can be applied. In a solvent dewaxing process, dewaxing solvents include acetone, methylethylketone (MEK), methylisobutylketone (MIBK), benzene, toluene, dichloromethane, dichloroethane and mixtures thereof. A portion of the solvent is mixed with the oil before chilling and additional chilled solvent is added to the oil at several points through the chilling train. The waxy oil and solvent are chilled at a rate of about 0.5° C. to 2.5° C. per minute until the desired waxing temperature is reached. This is usually in the range of −18° C. to −26° C. The mixture is filtered for separation of solidified wax, and a dewaxed lubricating oil base stock of the desired pour point, generally in the range of about −9° C. to −18° C. is obtained. Such a process is more fully described in U.S. Pat. No. 4,354,921 to H. J. Pitman et al., incorporated herein by reference.

Catalytic dewaxing is carried out by first subjecting the raffinate product of solvent extraction to a catalytic hydrotreating followed by a catalytic dewaxing also in the presence of hydrogen. Suitable catalysts comprise aluminum silicates such as ZSM-5 and related structures such as ZSM-8, ZSM-11, ZSM-23 and ZSM-35. This catalytic dewaxing is carried out at a temperature of 250° C. to 500° C., hydrogen pressure of 5 to 100 bar and hydrogen/oil ratio of 100 to 2500 std. liters/kg. oil. Such a process is more fully described in U.S. Pat. No. 4,764,265 to H. M. J. Bijwaard et al. incorporated herein by reference.

Acid treatment and/or clay treatment have been used to improve the resistance to oxidation of the product and to further improve the color and color stability of the product. However, acid treatment and clay treatment have been found to be unnecessary for the paraffinic base oils of the invention. Following dewaxing, a mild hydrogenation, referred to in the art as hydrofinishing, is carried out on the raffinate.

A mild hydrofinishing is carried out at a temperature of 500° F. to 600° F. at hydrogen rate of 70 to 100 SCF/bbl and hydrogen pressure of 500 to 1000 psig. Catalysts which are well-known for hydrofinishing include one or more metals of Groups VIB and VIII of the Periodic Table of elements or sulfides or oxides thereof on an alumina support. These metals include molybdenum, chromium, tungsten, platinum, nickel, iron and cobalt. These catalysts are commercially available.

Paraffinic lubricating oils are preferred because they are more easily washed from textile. Paraffinic base oils made according to this procedure are commercially available and typical properties are as follows:

textile machinery. It has been found that a paraffinic base lubricating oil need not be acid treated and clay treated to achieve the desired properties. Nor is a tackiness agent required.

The surfactant of the lubricating oil composition is an ethoxylate of secondary linear alcohols. These surfactants are represented by the formula:

$$R—O(CH_2CH_2O)_xH$$

wherein: R is a normal paraffin radical of 11 to 15 carbon atoms and x ranges from 3 to 5.

This group of surfactants is oil soluble and does not separate or form haze in the lubricating oil composition.

| | PARAFFINIC BASE OILS | | | | | | |
|---|---|---|---|---|---|---|---|
| | | PRODUCT NAME | | | | | |
| TYPICAL PROPERTIES | ASTM | ISO-10 | ISO-22 | ISO-32 | ISO-46 | ISO-68 | ISO-100 |
| Specific Gravity at 60° F. | D-1250 | 0.867 | 0.862 | 0.874 | 0.878 | 0.882 | 0.889 |
| Gravity, API | D-287 | 31.7 | 32.6 | 30.5 | 29.7 | 29.0 | 27.7 |
| Pounds/Gallon | D-1250 | 7.22 | 7.18 | 7.27 | 7.31 | 7.34 | 7.40 |
| Flash COC, °F. | D-92 | 345 | 380 | 400 | 415 | 440 | 470 |
| Pour, °F. | D-97 | 0 | 0 | 5 | 10 | 10 | 10 |
| Vis Kin, cSt @ 40° C. | D-445 | 12.7 | 19.9 | 29.9 | 44.3 | 64.0 | 109 |
| Vis Kin, cSt @ 100° C. | D-445 | 3.02 | 4.01 | 5.10 | 6.55 | 8.26 | 11.5 |
| Viscosity, SUS @ 100° F. | D-2161 | 72.4 | 105 | 154 | 229 | 332 | 571 |
| Viscosity, SUS @ 210° F. | D-2161 | 36.5 | 39.8 | 43.4 | 48.2 | 54.0 | 65.8 |
| Color, ASTM | D-1500 | L0.5 | 0.5 | 0.5 | 1.0 | L1.5 | 2.0 |
| Aniline Point, °F. | D-611 | 192 | 211 | 215 | 220 | 223 | 227 |
| Neutralization No. | D-974 | 0.01 | 0.02 | 0.03 | 0.02 | 0.01 | 0.06 |
| Distillation, °F. | D-2887 | | | | | | |
| IBP | | 561 | 576 | 596 | 573 | 587 | 600 |
| 10% | | 603 | 673 | 702 | 723 | 753 | 806 |
| 30% | | 648 | 709 | 756 | 780 | 824 | 891 |
| 50% | | 669 | 731 | 795 | 829 | 873 | 937 |
| 90% | | 710 | 834 | 903 | 924 | 981 | 1023 |
| 95% | | 730 | 879 | 942 | 961 | 1008 | 1046 |

Lubricating oil fractions from naphthenic crudes are processed by catalytic dewaxing or by catalytic hydrogenation followed by urea dewaxing. The catalytic hydrogenation is carried out at temperatures up to 500° C. and hydrogen partial pressures of up to 200 bar, using hydrogenation catalysts such as molybdenum, chromium, tungsten, vanadium, platinum, nickel, copper, iron or cobalt either as such or in the form of their oxides and/or sulfides and either supported on a suitable carrier such as alumina or silica, or unsupported.

Urea dewaxing is carried out by mixing a naphthenic oil with urea in the presence of a selected urea dewaxing solvent. The mixture is chilled and vigorously mixed for 3 to 4 hours to form a n-paraffin-urea adduct. The adduct is separated and a dewaxed naphthenic oil recovered. Urea dewaxing of naphthenic oils is more fully described in U.S. Pat. No. 4,504,376 to T. C. Mead et al. incorporated herein by reference.

Naphthenic crudes are typically found to require acid treating and clay treating and/or severe hydrotreating to produce color stable oils. Naphthenic lubricating oils are therefore less preferred than paraffinic oils because of the necessity for acid and clay disposal.

The instant lubricating oil composition comprises a solvent neutral paraffinic base oil that has been solvent refined and hydrofinished and has a viscosity of about ISO-10 to ISO-100. Also acceptable is a solvent extracted naphthenic pale oil or mixtures of paraffinic and naphthenic base oils. The mixtures are blended to give a viscosity of ISO 10 to ISO 100 preferably ISO 10 to ISO 68. The ISO viscosity is selected in this range to give the proper lubricity and tackiness at the operating temperature (100° F. to 250° F.), load and speed of the These compositions are formulated by procedures well-known in the art. They are typically formulated on-line at the cannery. In the alternative they can be formulated by hand in a semiworks. For example, about 10 wt% of the total base oil is added to a steam jacketed stainless steel kettle. The surfactant is weighed on a Toledo scale and then added to the kettle with stirring at ambient temperature to 100° F. Other additives are then weighed and introduced into the kettle. These may include an antioxidant, an antiwear agent and a defoamer. The remainder of the base oil is then slowly added to the kettle to make the final lubricating oil composition. The composition is canned and shipped to point of use.

The antioxidant is incorporated in amounts of 0.1 to 1.5 wt%. The antioxidant may be selected from any of the phenolic and amino antioxidants.

Phenols which are useful for this purpose include various alkylated phenols, hindered phenols and phenol derivatives such as t-butyl hydroquinone, butylated hydroxyanisole, polybutylated bisphenol A, butylated hydroxy toluene, alkylated hydroquinone, 2,5-ditert-aryl hydroquinone 2,6-ditert-butyl-para-cresol, 2,2'-methylenebis(6-tert-butyl-p-cresol); 1,5-naphthalenediol; 4,4'-thiobis(6-tert-butyl-m-cresol); p,p-biphenol; butylated hydroxy toluene; 4,4'-butylidenebis(6-tert-butyl-m-cresol); 4-methoxy-2,6-ditert-butyl phenol; and the like.

Amino antioxidants include aldehyde amines, ketone amines, ketone-diarylamines, alkylated diphenylamines, phenylenediamines and the phenolic amines.

The antiwear agent may include any of the commercially available products such a s those based on chlorinated paraffins and are sold for the manufacture of textiles based on their light color and absence of harm to textile. Tricresyl phosphate is also used as well as mixtures of tricresyl phosphate and chlorinated paraffins. These antiwear agents may be incorporated in amounts of 0.01 to 1.5 wt%.

A number of silicone oils and silicone free compositions are sold commercially for defoaming in machinery. The defoamer may be used in amounts as prescribed by technical service brochures of about 5 to 20 ppm.

The oil pan of a textile knitting machine is drained and flushed. Lubricated surfaces are wiped clean of oil and deposits with a clean, lint free cotton cloth. The oil pan is refilled with the lubricating oil composition of the invention. Fresh lubricating composition is lightly brushed or sprayed on contact surfaces.

The knitting machine is restarted and lubricating oil mists contact the textile. The knitted textile is recovered from the machine in bolts of textile. The textile is next washed in industrial size washing machines with ambient temperature water of about 65° F. or higher with or without the addition of surfactant for about 30 minutes. The washed textile is placed in tumble dryers where it is blown with heated air for 15 to 20 minutes. The washed and dried fabric is inspected and found to be stain free. The fabric is stretched as it is rewound on the bolt.

This invention is shown by way of example.

EXAMPLE 1

Three samples of the textile machine lubricating oil were each stored for one month to test storage stability.

The first sample was stored undisturbed at room temperature. The second sample was stored dry at 130° F. The third sample was stored with the addition of 5 vol% distilled water at 130° F.

The samples showed no change in color or clarity after one month of storage.

EXAMPLE 2

The non-staining properties of textile machine lubricating oils was measured by a modified American Association of Textile Chemist and Colorist Test AATCC 130 (Oily Stain Release Method). The test was modified as follows: All stained fabric specimens were safety pinned to a cotton towel to keep the pieces of cloth from being damaged in the washing machine. To simulate a mild water wash, no detergent was added to the washing machine. Following washing, the towel and cloth specimens were air dried.

In the test, fabric samples were stained with a measured amount of oil. The stained fabric was pinned to the cotton towel and machine washed for 12 minutes with normal agitation in both wash and rinse cycles. The towel and samples were then air dried. Residual stain was rated on a scale of 1 to 5 by comparison with the standard stain release replica (AATCC-130).

Results are reported in Table I.

TABLE I

| Blend Description | Wt % | AATCC 130 | Storage Stability Test |
|---|---|---|---|
| 1) Paraffinic Base Oil | 100% | 3 | Clear and Bright |
| 2) Naphthenic Base Oil | 100% | 3 | Clear and Bright |
| 3) Naphthenic Base Oil | 99% | 5 | Separated into two phases |
| L24-7 Surfonic Surfactant | 1% | | |
| 4) Naphthenic Base Oil/ATCC | 99% | 4 | Separated into two phases |
| L24-7 Surfonic Surfactant | 1% | | |
| 5) Paraffinic Base Oil | 99% | 5 | Separated into two phases |
| L24-7 Surfonic Surfactant | 1% | | |
| 6) Paraffinic Base Oil | 99% | 4 | Hazy, did not separate |
| JL-80X Surfonic Surfactant | 1% | | |
| 7) Paraffinic Base Oil | 99% | 5 | Separated into two phases |
| LF-17 Surfonic Surfactant | 1% | | |
| 8) Paraffinic Base Oil | 99% | 5 | Hazy, did not separate |
| Plurafac D-25 Surfactant | 1% | | |
| 9) Paraffinic Base Oil | 99% | 5 | Clear and Bright |
| Tergitol 15-S-3 Surfactant | 1% | | |
| 10) Paraffinic Base Oil | 99% | 5 | Clear and Bright |
| Tergitol 15-S-5 Surfactant | 1% | | |
| 11) Paraffinic Base Oil | 99% | 5 | Slightly hazy, did not separate |
| Terigtol 15-S-7 Surfactant | 1% | | |
| 12) Paraffinic Base Oil | 99% | 4 | Clear and Bright |
| Exxal 12-3 Surfactant | 1% | | |
| 13) Paraffinic Base Oil | 99% | 5 | Hazy, did not separate |
| Exxal 12-6 Surfactant | 1% | | |
| 14) Paraffinic Base Oil | 99% | 5 | Separated into two phases |
| Exxal 12-8 Surfactant | 1% | | |
| 15) Naphthenic Base Oil | 99% | 5 | Clear and Bright |
| Tergitol 15-S-3 Surfactant | 1% | | |
| 16) Naphthenic Base Oil | 99% | 5 | Clear and Bright |
| Tergitol 15-S-5 Surfactant | 1% | | |
| 17) Paraffinic Base Oil | 97% | 5 | Clear and Bright |
| Tergitol 15-S-3 Surfactant | 3% | | |
| 18) Paraffinic Base Oil | 95% | 5 | Slight hazy, did not separate |
| Tergitol 15-S-3 Surfactant | 5% | | |
| 19) Paraffinic Base Oil | 97% | 5 | Slight hazy, did not separate |
| Tergitol 15-S-5 Surfactant | 3% | | |
| 20) Paraffinic Base Oil | 95% | 5 | Hazy, did not separate |
| Terigtol 15-S-5 Surfactant | 5% | | |

TABLE OF COMPONENTS

| | |
|---|---|
| Tergitol 15-S-3 | The Condensation product of $C_{11}$ to $C_{15}$ linear secondary alcohol with 3 moles of ethylene oxide, Union Carbide Inc. |

TABLE I-continued

| | |
|---|---|
| Tergitol 15-S-5 | Condensation product of $C_{11}$ to $C_{15}$ linear secondary alcohol with 5 moles of ethylene oxide, Union Carbide Inc. |
| Exxal 12-3 | $C_{12}$ branched alcohol with 3 moles of ethylene oxide, Exxon. |
| Exxal 12-6 | $C_{12}$ branched alcohol with 6 moles of ethylene oxide, Exxon. |
| Exxal 12-8 | $C_{12}$ branched alcohol with 8 moles of ethylene oxide, Exxon. |
| Plurafac D-25 | $C_{12}$—$C_{15}$ branched alcohol, BASF. |
| LF-17 Surfonic | $C_8$—$C_{18}$ linear primary alcohol with ethylene and propylene oxide, Texaco. |
| L-24-7 Surfonic oxide, | $C_{12}$—$C_{14}$ linear primary alcohol with 7 moles of ethylene Texaco. |
| JL-80X Surfonic | $C_8$—$C_{18}$ alkoxylated linear alcohols, Texaco. |
| Paraffinic Base Oil | A lubricant base oil derived from paraffinic crudes. |
| Naphthenic Base Oil | A lubricant base oil derived from naphthenic crudes. |
| Naphthenic Base Oil/ATCC | A lubricant base oil derived from naphthenic crudes that has been acid treated and clay contacted. |

The data in Table I shows that a non-staining lubricant for textile equipment contains 1 wt% to 5 wt% of linear secondary alcohol ethoxylate surfactants. Best results were achieved with 1 wt% to 3 wt% surfactant. Paraffinic base oils are recommended. Naphthenic base oils can be used but paraffinic base oils have higher viscosity indexes and outperform naphthenic base oils in most high temperature applications.

Table II is a list of product compositions.

TABLE II

| | Composition, Wt % | Preferred Composition |
|---|---|---|
| Paraffinic Base Oil | 95-99% | 97-99% |
| Tergitol 15-S-3 | 1-5% | 1-3% |
| Naphthenic Base Oil | 95-99% | 97-99% |
| Tergitol 15-S-3 | 1-5% | 1-3% |
| Paraffinic Base Oil | 95-99% | 97-99% |
| Tergitol 15-S-5 | 1-5% | 1-3% |
| Naphthenic Base Oil | 95-99% | 97-99% |
| Tergitol 15-S-5 | 1-5% | 1-3% |

EXAMPLE 3 -BEST MODE

The compositions comprising 99 wt% paraffinic base oil with 1 wt% Tergitol 15-S-5 and 99 wt% paraffinic base oil with 1 wt% Tergitol 15-S-3 in the absence of any other additive were each field tested in a large nylon hosiery mill. Both compositions were found to be non staining to nylon hosiery after washing. The composition comprising paraffinic base oil and Tergitol 15-S-5 is the Best Mode contemplated by inventor at the time of filing this application.

While particular embodiments of the invention have been described, it will be understood, of course, that the invention is not limited thereto since many modifications may be made, and it is, therefore, contemplated to cover by the appended claims any such modification as fall within the true spirit and scope of the invention.

WHAT IS CLAIMED IS:

1. A method of lubricating a textile weaving machine comprising:

applying to lubricated surfaces a lubricating oil composition comprising:

a major portion of a mineral base lubricating oil, and 1 to 5 wt% of an oil soluble surfactant of the formula:

$$R—O(CH_2CH_2O)_xH$$

wherein: R is a normal paraffin radical of 11 to 15 carbon atoms, and x ranges from 3 to 5.

2. The method of claim 1 wherein the lubricating oil composition comprises 1 to 3 wt% of the surfactant.

3. The method of claim 1 wherein the mineral base lubricating oil has a viscosity of ISO 10 to ISO 100.

4. The method of claim 1 wherein the mineral base lubricating oil is a paraffinic base oil.

5. The method of claim 1 wherein x is 3.

6. The method of claim 1 wherein x is 5.

7. A method of lubricating a textile weaving machine comprising:

applying to lubricated surfaces a lubricating oil composition comprising:

a major portion of a paraffinic base lubricating oil of a viscosity ISO 10 to ISO 100, and 1 to 5 wt% of an oil soluble surfactant of the formula:

$$R—O(CH_2CH_2O)_xH$$

wherein: R is a normal paraffin radical of 11 to 15 carbon atoms, and x ranges from 3 to 5.

8. The method of claim 7 wherein the lubricating oil composition comprises 1 to 3 wt% of the surfactant.

9. The method of claim 7 wherein x is 3.

10. The method of claim 7 wherein x is 5.

11. The method of claim 7 wherein the paraffinic base lubricating oil has a viscosity of ISO-10 to ISO-68.

* * * * *